United States Patent [19]

Skinner et al.

[11] Patent Number: 4,491,511

[45] Date of Patent: Jan. 1, 1985

[54] TWO-STAGE COAL LIQUEFACTION PROCESS

[75] Inventors: Ronald W. Skinner, Allentown; John C. Tao, Perkiomenville, both of Pa.; Samuel Znaimer, Vancouver, Canada

[73] Assignee: International Coal Refining Company, Allentown, Pa.

[21] Appl. No.: 549,693

[22] Filed: Nov. 7, 1983

[51] Int. Cl.[3] ..... C10G 1/00; C10G 1/06; C10G 17/04; C10G 21/02

[52] U.S. Cl. ..... 208/8 LE; 208/10; 208/312; 208/315; 208/322; 208/366

[58] Field of Search ..... 208/8 LE, 10, 366, 312, 208/315, 322

[56] References Cited

U.S. PATENT DOCUMENTS

| | | | |
|---|---|---|---|
| 4,070,268 | 1/1978 | Davis et al. | 208/8 |
| 4,094,766 | 6/1978 | Gorin | 208/10 |
| 4,119,523 | 10/1978 | Baldwin et al. | 208/8 |
| 4,164,466 | 8/1979 | Baldwin et al. | 208/8 LE |
| 4,189,372 | 2/1980 | Baldwin et al. | 208/8 LE |
| 4,230,556 | 10/1980 | Carr et al. | 208/8 LE |
| 4,251,346 | 2/1981 | Dry et al. | 208/10 |
| 4,328,088 | 5/1982 | Anderson et al. | 208/8 LE |
| 4,334,977 | 6/1982 | Derbyshire et al. | 208/8 LE |
| 4,338,182 | 7/1982 | Vernon et al. | 208/8 LE |
| 4,347,117 | 8/1982 | Bauman et al. | 208/8 LE |
| 4,372,838 | 2/1983 | Kulik et al. | 208/10 |
| 4,374,015 | 2/1983 | Brulé208 | 8 LE/ |
| 4,377,464 | 3/1983 | Carr et al. | 208/8 LE |

*Primary Examiner*—William G. Wright

*Attorney, Agent, or Firm*—Kimbley L. Muller

[57] ABSTRACT

An improved SRC-I two-stage coal liquefaction process which improves the product slate is provided. Substantially all of the net yield of 650°-850° F. heavy distillate from the LC-Finer is combined with the SRC process solvent, substantially all of the net 400°-650° F. middle distillate from the SRC section is combined with the hydrocracker solvent in the LC-Finer, and the initial boiling point of the SRC process solvent is increased sufficiently high to produce a net yield of 650°-850° F. heavy distillate of zero for the two-stage liquefaction process.

1 Claim, 1 Drawing Figure

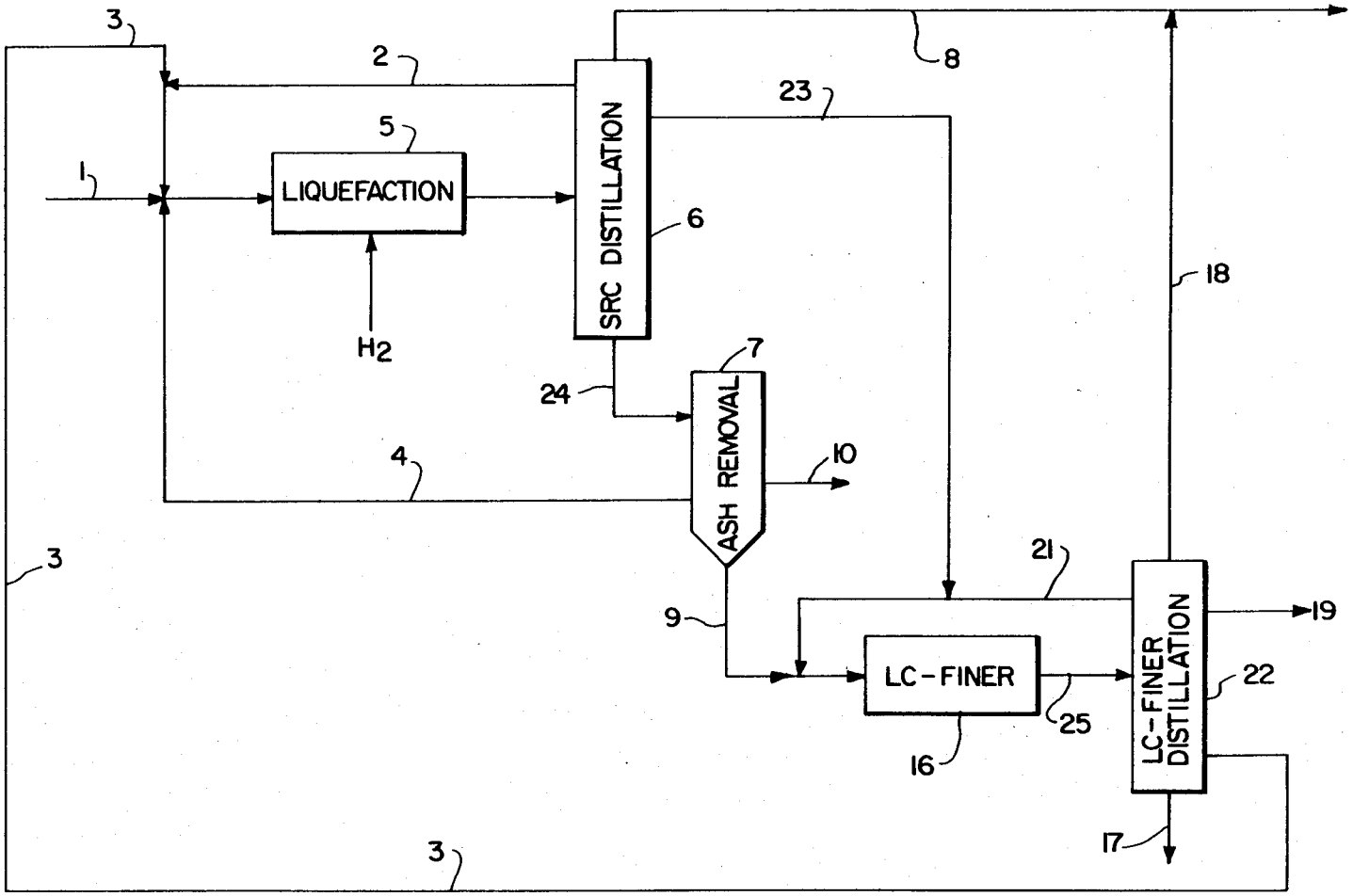
LIQUEFACTION
SRC DISTILLATION
ASH REMOVAL
LC-FINER
LC-FINER DISTILLATION
H2
1
2
3
4
5
6
7
8
9
10
16
17
18
19
21
22
23
24
25

TWO-STAGE COAL LIQUEFACTION PROCESS

The Government of the United States of America has rights to this invention pursuant to Contract No. DE-AC05-780RO3054 awarded by the U.S. Department of Energy.

DESCRIPTION

1. Technical Field

This invention relates to the solvent refining of coal. More particularly, this invention relates to an improvement in the SRC-I two-stage liquefaction process which results in an improved product slate.

2. Background Art

In the solvent refining of coal, a coal/solvent slurry is treated in a reactor at elevated pressure and temperature in the presence of hydrogen. This process is referred to in the art as SRC-I, solvent refined coal having the acronym SRC.

In a refinement of the SRC-I process, the SRC-I front end process has been combined with an ebullated-bed hydrocracking process, called LC-Fining. The resultant process, which shifts production towards distillates, is referred to as the SCR-I two-stage liquefaction process. A general description of this two-stage process is included on the text "PENNSYLVANIA COAL: Resources, Technology and Utilization" edited by Shyamal K. Majumdar and E. Willard Miller and published by the Pennsylvania Academy of Science, pages 214-227 (1983).

In the SRC-I two-stage liquefaction process (hereinafter also simply referred to as the two-stage liquefaction process), the coal is treated in the SRC section to obtain a light distillate product (up to 400° F. boiling point), distillate SRC recycle solvent, solvent refined coal (including light SRC and heavy SRC), a solid residue, a middle distillate product (boiling from about 400°-650° F.) and a heavy distillate product (boiling from about 650°-850° F.) Solvent refined coal from the SRC section is combined with hydrocracker solvent and subjected to hydrocracking in the hydrocracking zone (hereinafter also referred to as the LC-Finer) to obtain a light distillate product, a middle distillate product, a heavy distillate product (boiling from 650°-850° F.), hydrocracker solvent and two-stage liquefaction solvent refined coal (TSL SRC).

The product liquids from the SRC section are of significantly lower quality than the LC-Finer product liquid in terms of heteroatom content, stability and heating value. Additionally, the 650°-850° F. heavy distillate product from the LC-Finer has a lower economic value than the light distillate product, i.e., naphtha, and the 400°-650° F. middle distillate product from the LC-Finer.

DISCLOSURE OF INVENTION

The present invention provides an improved product slate in the SRC-I two-stage liquefaction process and is characterized in that substantially all of the net yield of 650°-850° F. heavy distillate from the LC-Finer is combined with the solvent used to prepare the coal/solvent slurry feed for the liquefaction reaction; substantially all of the net 400°-650° F. middle distillate from the SRC section is combined with the hydrocracker solvent in the LC-Finer section; and the initial boiling point of the solvent used in the SRC section is increased such that there is no net yield of 650°-850° F. heavy distillate in the process. The net liquid products obtained according to the improved two-stage liquefaction process of the invention are substantially limited to naphtha and the 400°-650° F. middle distillate from the LC-Finer.

BRIEF DESCRIPTION OF DRAWING

The drawing shows a simplified block flowsheet of the improved SRC-I two-stage liquefaction process according to the invention.

BEST MODE FOR CARRYING OUT THE INVENTION

A characteristic feature of the two-stage liquefaction process according to the present invention is that the initial boiling point of the coal-derived solvent (hereinafter: the SRC process solvent) that is mixed with finely divided coal in a slurry preparation zone to form a coal/solvent feed slurry, is increased, without changing its end point, substantially above the initial boiling point of about 350°-450° F. conventionally used in the process.

When the initial boiling point of the SRC process solvent is increased, without changing the end point, the fraction of the total solvent that falls into the 650°-850° F. heavy distillate boiling range is increased. Since a portion of the process solvent will always thermally crack to gases and lower boiling liquids in the SRC reaction zone; i.e., dissolver section, increasing the concentration of heavy distillate in the solvent will increase the quantity of heavy distillate destroyed by craking in the dissolver. If the initial boiling point is set sufficiently high, the quantity of heavy distillate that is destroyed by cracking reactions in the dissolver will balance the quantity of heavy distillate produced from coal in the dissolver plus the net quantity of heavy distillate produced from the solvent refined coal in the hydrocracker.

The fact that increasing the initial boiling point (IBP) of the process solvent will reduce the yield of the less desirable 650°-850° F. heavy distillate is illustrated by the data shown in Table I. The data show that as the solvent IBP is increased, more heavy distillate is cracked than is produced in the dissolver. At the same time there is no substantial change in the total amount of distillate produced in the first stage. The yields reported in the table are in percent by weight based on the weight of the feed coal (MAF). The reaction conditions of the pilot plant test used to obtain the data of Table I are shown in Table II.

TABLE I

EFFECT OF SOLVENT IBP ON DISTILLATE YIELD

| Solvent IBP | Percent Change In Total Distillate Yield | Percent Change In Heavy Distillate Yield |
|---|---|---|
| 389° F. | 0 | −27 |
| 445° F. | −2 | −40 |
| 538° F. | 0 | −46 |

TABLE II

REACTION CONDITIONS

| | |
|---|---|
| Coal | Lafayette KY #9 |
| Solvent | Distilled from Ft. Lewis process solvent collected during SRC-I operating mode |
| Wt % Coal | 40% |
| Temperature | 840° F. |
| Pressure | 2,000 psig |
| Reaction Time | 45 minutes (based on superficial liquid velocity, ambient temperature) |

TABLE II-continued

| REACTION CONDITIONS | |
|---|---|
| Gas Rate | 30,000 scf/ton coal |
| Feed | Pure $H_2$ |

The increase in the initial boiling point of the SRC process solvent required to reduce the overall net yield of 650°-850° F. heavy distillate for the improved two-stage liquefaction process of the invention to zero will depend on the composition of the coal and the hydrocracker operating conditions and can be determined experimentally in the same manner as in this example. For example, as the initial boiling point of the solvent is increased, the amount of 650°-850° F. heavy distillate in the SRC solvent fraction produced by distillation (SRC distillate) of the coal liquefaction product (following the removal of light gases) can be monitored. The overall net yield of 650°-850° F. heavy distillate will be zero when there is no accumulation of the heavy distillate in the SRC solvent fraction. Typically, the initial boiling point of the SRC process solvent will have to be increased to at least about 500 F.

The initial boiling point of the SRC process solvent can be controlled by controlling the distillation columns used in the SRC distillation zone as will be understood by those skilled in the art.

A further characteristic feature of the improved two-stage liquefaction process of the invention is that the net 400°-650° F. middle distillate product from the SRC area is sent to the hydrocracker area, i.e., LC-Finer. As a result of this feature, substantially all of the net middle distillate product of the two-stage liquefaction process is taken from the LC-Finer. The superior quality of the LC-Finer middle distillate as compared to the middle distillate from the SRC section is illustrated in Table III. The similarity in hydrogen content between the LC-Finer middle distillate and the middle distillate from the SRC section as shown in Table III indicates that the routing of the middle distillate product from the SRC section to the LC-Finer will have a minimal impact on the overall hydrogen consumption required in the two-stage liquefaction process.

TABLE III

| | LC-Finer Distillates | SRC Distillates |
|---|---|---|
| Boiling Range, °F. | 400-650° F. | 400-650° F. |
| API Gravity | 14 | 9 |
| Wt % C | 88.1 | 86.6 |
| Wt % H | 8.9 | 8.7 |
| Wt % O | 0.14 | 3.39 |
| Wt % N | 0.20 | 0.75 |
| Wt % S | 0.06 | 0.38 |
| Pour Pt., °F. | −45° F. | −40° F. |
| Conradson Carbon, Wt % | 0.00 | 0.02 |
| Heating Value, Btu/lb | 18,400 | 17,300 |

A further characteristic feature of the improved two-stage liquefaction process according to the present invention is that substantially all of the net yield of 650°-850° F. heavy distillate from the LC-Finer is recycled to the SRC front-end where it is combined with the SRC process solvent and used to prepare the coal/solvent slurry feed. By recycling only the heavy distillate from the LC-Finer to the SRC front-end, the disadvantages of cracking recycled 400°-650° F. middle distillates in the front-end and producing an overhydrogenated solvent that cannot dissolve all of the SRC produced in the dissolver are avoided. By recycling the heavy distillate from the hydrocracker to the SRC front-end and by an appropriate increase in the initial boiling point of the SRC process solvent, the net yield of 650°-850° F. heavy distillate produced from the SRC-I two-stage liquefaction process can be reduced to essentially zero.

To assist in a better understanding of the improved process according to the present invention, the process will be described in conjunction with the simplified block flow sheet shown in the drawing. Coal 1 is mixed with a coal-derived solvent consisting of SRC process recycle solvent 2 from the SRC-I coal liquefaction area 5 and SRC distillation 6, the net heavy distillate 3 from the LC-Finer and, optionally, a light SRC product fraction taken from ash removal unit 7, e.g., light SRC 4 from a Kerr-McGee critical solvent deashing unit (K-M CSD). The initial boiling point of the SRC process recycle solvent is set at the temperature where the overall integrated process has a zero net yield of 650°-850° F. heavy distillate product. The coal/solvent slurry contains from 20 to 45 wt. % of coal and from 0 to 10 wt. % of the optional SRC fraction.

The coal is mixed with the solvent in a coal slurry mix tank (not shown) at temperatures from ambient to 450° F. The slurry mix tank may be maintained at elevated temperatures to improve the thermal efficiency of the process. A portion of the moisture entrained in the feed coal is removed in the slurry mix tank.

In the liquefaction area 5 the coal/solvent slurry is pressurized to between 1,000 to 3,200 psig and is then mixed with a hydrogen-rich gaseous stream that is all or part of the total hydrogen that is fed to the SRC front-end of the integrated process at a ratio of from 10 to 40 Mscf per ton of feed coal. The resultant three-phase gas/slurry stream is then introduced into a preheater system comprised of a tubular reactor having a length to diameter ratio greater than 200 and, more preferably, greater than 500. The temperature of the three-phase mixture is increased from the appropriate temperature in the slurry mix tank to an exit temperature of 600° to 800° F. In the preheater section, the viscosity of the slurry changes as the slurry flows through the tube initially forming a gel-like material which shortly thereafter diminishes sharply in viscosity to a relatively freely flowing fluid. The exit slurry from the preheater section contains little undissolved coal.

The preheated slurry is then passed to a coal liquefaction stage whereat the slurry is passed in series through one or more dissolvers which may be in series or parallel. Each dissolver comprises a tubular vessel operated in an adiabatic mode without the addition of significant external heat. The length-to-diameter ratio of each of the dissolver vessels is considerably less than that employed in the preheater section of the process.

Typically, more hydrogen is added to the mixture in the dissolvers so that the total amount of hydrogen used in the preheater and dissolvers is 10-40 Mscf per ton of coal and typically about 30 Mscf per ton of coal.

The temperature of the mixture increases due to exothermic-hydrogenation reaction in the dissolvers to a temperature within the range of 740°-860° F. and, generally, of about 840° F. In the dissolvers, the coal and solvent undergo a number of chemical transformations including, but not necessarily limited to, further dissolution of the coal; hydrogen transfer from the solvent to the coal; rehydrogenation of recycled solvent; removal of heteroatoms, including sulfur, nitrogen, and oxygen, from the coal and recycle solvent; reduction of certain components in the coal ash, e.g., $FeS_2$ to FeS; and cracking of heavy coal liquids. The mineral matter in the coal can catalyze these reactions.

The flow rate of the mixture through the dissolvers is chosen so as to maintain good agitation which insures good mixing. The quantity of solids that accumulate in the dissolvers is typically quite small based on the feed. Preferably, the concentration of solids in the dissolvers will serve to catalyze the reactions. Because of the inherent accumulation phenomenon, it is desirable that a solids withdrawal system be placed into the dissolvers so that excessive accumulated solids can be removed from the system. Generally, the residence time of the mixture in the dissolvers will be from 10 minutes to 2 hours, generally about 40 minutes.

The material leaving the dissolvers is cooled and passed to a vapor/liquid separation zone (not shown). In this zone, the material is separated into a vapor product and condensed product. Light gases, e.g., hydrogen, $H_2S$, $CO_2$, ammonia, $H_2O$, and $C_1$–$C_4$ hydrocarbons which are separated to pass to a hydrogen recovery section whereat these gases are scrubbed to remove acidic and alkaline components while the hydrogen and lower hydrocarbons may be recycled to various stages in the process or burned for fuel.

The condensed product passes to an SRC, or first-stage, distillation section 6 wherein it is separated into a first-stage light distillate fraction 8 (up to 400° F.), a first-stage SRC process recycle solvent fraction 2 (650°–850° F.), a first-stage net SRC middle distillate fraction 23 (400°–650° F.) and a residual bottoms product 24.

The SRC recycle process solvent 2 is passed to the slurry preparation zone where it is combined with the net LC-Finer heavy distillate 3. The initial boiling point of the SRC process recycle solvent fraction is adjusted, as discussed above, as required to provide a net yield of 650°–850° F. heavy distillate for the two-stage liquefaction process of zero. The minimum initial boiling point will be about 500° F.

The residual bottoms product 24 is passed to an ash removal zone 7 where it is separated into an ash residue 10 and solvent refined coal (SRC). The SRC product may optionally include a light SRC fraction 4 which is recycled to the slurry preparation zone and is used to make the initial coal/solvent slurry.

Solvent refined coal 9 from the deashing section is mixed with hydrocracker solvent 21 and is hydrocracked in LC-Finer area 16.

As described above, a characteristic feature of the two-stage liquefaction process according to the present invention is that the net 400°–650° F. middle distillate 23 from the SRC section is combined with the hydrocracker solvent 21 in the hydrocracker, or LC-Finer, section.

In the LC-Finer, the SRC, at a concentration of 40 to 80 wt.% in the total solvent (hydrocracker solvent 21 and SRC middle distillate 23)/SRC mixture is pumped to 1500 to 3500 psig pressure and then is preheated before entering the hydrocracking reactor. The hydrocracking reactor is generally an ebullated bed reactor with an internal liquid recycle to partially fluidize the catalyst. As the catalyst, a nickel/molybdenum catalyst or a cobalt/molybdenum catalyst is typically used. The hydrocracking reactor is operated at a pressure of 1500–3500 psig, a temperature of 700°–850° F., a superficial liquid space velocity of 1–6 hrs.$^{-1}$ based on total feed, and a hydrogen treat rate of 5,000–25,000 scf/BBL.

In the hydrocracker, at least 30% and, generally, 30–90% of the 850° F+ SRC is converted to gas and liquid products boiling below about 850° F. Other reactions occurring in the hydrocracker include the removal of sulfur, nitrogen, and oxygen heteroatoms from the SRC and liquids and hydrogenation of the liquids.

The hydrocracked product from the hydrocracking reactor is flashed at high and low pressure to recover recycle hydrogen and process gas (not shown) which are fractionated and purified in the same manner as described for the SRC area. The liquid hydrocracked product 25 from the flash stages is sent to the LC-Finer distillation 22 where it is fractionated into a light distillate fraction 18, the net 400°–650° F. middle distillate product 19, hydrocracker solvent fraction 21, 650°–850° F. heavy distillate fraction 3 and two-stage liquefaction solvent refined coal (TSL SRC) product 17. Substantially all of the heavy distillate is sent to the SRC area and, more particularly, to the slurry preparation zone, where it is combined with the SRC process recycle solvent. The light distillate 18 and middle distillate product 19 are net product streams. The hydrocracker solvent 21 is recycled to the LC-Finer area 16.

In an alternative embodiment of the foregoing process, a portion of the SRC product from the ash removal unit 7 may be solidified for sale as a boiler fuel or fed to a coker/calciner for the production of anode coke.

The improved two-stage liquefaction process according to the present invention is further illustrated in the following example.

EXAMPLE

A slurry of 37–39 wt% Illinois #6 coal from the Burning Star Mine in process-derived solvent was processed in a 6 ton per day SRC-I two-stage pilot unit at Wilsonville, Ala. Reaction conditions for this run were a reaction temperature of 801°–815° F., a reaction pressure of 2400 psig, a coal space rate of 19.8–22.6 pounds coal/(ft$^3$ reactor-hr), and 85 mole % hydrogen purity for a gas feed rate of 49.7–53.9 mscf/ton of coal. In order to control the build-up of solids in the reactor, the solids withdrawal system purged solids/reactants from the bottom of the reactor at a rate equivalent to 6–8% of the slurry feed.

During this run, from July 28 onward, the operation of the SRC distillation was altered in order to increase the proportion of the high-boiling heavy distillate portion of the process solvent, by withdrawing a side stream of lighter-boiling fractions from the vacuum column, so that this light fraction is not included in the process solvent. This is equivalent to increasing the initial boiling point of the first-stage SRC-I process solvent.

The net SRC distillate product was taken from an upper tray of the vacuum distillation column, and hence, contained essentially no 650° F+ heavy distillate. As the run progressed, the boiling range of the process solvent became progressively heavier as the solvent approached the equilibrium composition for the operating case in which the heavy distillate would be recycled to extinction. On July 28, when the change in operating mode was initiated, the solvent contained about 5 wt% of light components boiling below 450° F. and contained 28 wt% of heavy components boiling above 650° F. Based upon a microautoclave kinetic solvent quality test, the solvent had a quality of 69. (Note: solvent quality is a measure of a solvent's ability to prevent coking in the fired heater. Its units are the wt% of the standard maf coal converted to tetrahydrofuran soluble products at standard reaction conditions. As is the case in the fired preheater, the solvent quality test does not permit gaseous $H_2$ to be transferred to the solvent—hence, donatable hydrogen in the solvent molecules and labile coal hydrogen, which the solvent can shuttle to the reaction site, are the only hydogen sources to support the coal conversion reactions. A higher value for the solvent quality index is favorable.)

Table IV shows that for four complete material balance calculation periods from the run, the concentration of heavy (650° F.) constituents in the process solvent increased from 41.2 wt% to 65.3 wt%. The concentration of light (420° F.) constituents declined from 4.6 wt% to 0.8 wt%. This change in solvent boiling range coincided with an improvement in solvent quality from 74 to 79. Thus, increasing the solvent boiling range was shown to be beneficial, even though it decreases the overall hydrogen content of the solvent. This apparently occurs because higher boiling point (higher molecular weight) aromatic and hydroaromatic components in the solvent can transfer and shuttle hydrogen more rapidly than can lower boiling (lower molecular weight) aromatic and hydroaromatic solvent components.

Table V shows the net product yields for the same material balance points. The change in solvent composition and solvent quality has little effect upon product yields, and so is at least neutral in impact. Hydrogen consumption appears to decrease slightly from 2.6 to 2.3 wt% as the yield of $C_1$–$C_5$ byproduct gases also decreases slightly from 7.5 to 6.7% of the maf coal.

It may be seen that the operating mode for this run successfully reduced the yield of 650° F. heavy components to less than 1% (maf coal basis) for all four balance periods. This quantity of heavy components can readily be included in the middle distillate product stream, giving no net yield of heavy distillate.

This run was operated successfully for nearly two months, thus demonstrating the operability and viability of recycling heavy distillate to extinction. By further increasing the initial boiling point of the solvent the heavy distillate yield would be further reduced which would enable the net heavy distillate from the LC-Finer to be recycled to the SRC front-end and combined with the SRC process solvent to give a net yield of 650°–850° F. heavy distillate of zero for the process. Combining the net 400°–650° F. middle distillate from the SRC section with the hydrocracker solvent could also be carried out without any deleterious effects.

TABLE IV

| | Solvent Quality | | | |
|---|---|---|---|---|
| Date | 8/10/82 | 8/20/82 | 9/15/82 | 9/24/82 |
| Balance period | A | B | C | D |
| Solvent Boiling Range, wt. % | | | | |
| IBP–450° F. | 4.6 | 2.5 | 0.5 | 0.8 |
| 450–550° F. | 27.0 | 17.7 | 8.4 | 9.5 |
| 550–650° F. | 24.2 | 23.6 | 21.7 | 21.3 |
| 650° F.–EP | 41.2 | 53.2 | 66.4 | 65.3 |
| Residue | 3.0 | 3.0 | 3.0 | 3.0 |
| Solvent Quality Index (Kinetic) | 74 | 77 | 80 | 79 |
| Hydrogen, wt % | 8.4 | 8.3 | 8.4 | 8.1 |

TABLE V

PRODUCT YIELDS, RECYCLE HEAVY DISTILLATE TO EXTINCTION

| Date | 8/10/82 | 8/20/82 | 9/15/82 | 9/24/82 |
|---|---|---|---|---|
| Balance Period | A | B | C | D |
| Product Yield (wt % maf coal) | | | | |
| CO, $CO_2$ | 1.8 | 1.7 | 1.6 | 1.7 |
| $NH_3$, $H_2S$ | 2.3 | 1.9 | 2.0 | 2.6 |
| $H_2O$ | 5.7 | 7.5 | 7.8 | 6.9 |
| $C_1$–$C_5$ | 7.5 | 6.4 | 6.8 | 6.7 |
| Distillate yield | 22.1 | 20.1 | 20.3 | 23.7 |
| IBP–200 ° F. | 2.0 | 1.2 | 1.1 | 1.5 |
| 200–350° F. | 3.3 | 2.4 | 2.1 | 3.0 |
| 350–450 ° F. | 5.6 | 5.3 | 4.0 | 5.9 |
| 450–550° F. | 7.2 | 8.0 | 8.6 | 7.9 |
| 550–650° F. | 2.9 | 2.2 | 3.8 | 3.8 |
| 650° F.–EP | 1.0 | 1.0 | 0.7 | 0.9 |
| Net SRC | 44.7 | 45.7 | 43.3 | 42.3 |
| Oils | 9.8 | 10.7 | 10.0 | 8.8 |
| Asphaltene | 24.6 | 21.6 | 20.2 | 22.7 |
| Preasphaltene | 10.2 | 13.4 | 13.1 | 10.9 |
| Ash Concentrate Reject | 31.5 | 31.8 | 33.7 | 31.6 |
| $H_2$ Consumed, wt % maf coal | 2.6 | 2.3 | 2.4 | 2.3 |
| Sulfur in SRC, wt % | .7 | .8 | .7 | .7 |

Although the invention has been described in conjunction with certain preferred embodiments thereof, it is not intended to be limited to these embodiments but instead includes all those emodiments within the scope and spirit of the claim that follows.

What is claimed is:

1. In a two-stage coal liquefaction process comprising the steps of:

(a) combining finely divided coal with a solvent therefor in a slurry preparation zone to form a coal/solvent slurry;

(b) pressuring said slurry to between 1000 to 3200 psig;

(c) contacting said coal/solvent slurry with hydrogen rich gas to form a gas/slurry mixture;

(d) heating said gas/slurry mixture in the presence of said hydrogen-rich gas to a temperature of from 600° to 800° F.;

(e) passing the heated gas/slurry mixture to an adiabatic dissolver and adding additional hydrogen as required to dissolve a major portion of the coal and form a liquefied coal slurry;

(f) separating said liquefied coal slurry into a vapor product and condensed product;

(g) passing said condensed product to a distillation zone wherein it is separated into a first-stage light distillate fraction, a first-stage solvent fraction, a first-stage middle distillate fraction and a residual bottoms product;

(h) passing said first-stage solvent fraction to the slurry preparation zone where it is combined with finely divided coal in step (a);

(i) separating said residual bottoms product in a deashing zone into an ash residue and a solvent refined coal product;

(j) combining at least a portion of the solvent refined coal product with a hydrocracker solvent in a hydrocracking zone and hydrocracking the resultant mixture to produce a hydrocracked product; and (k) separating the hydrocracked product into a second-stage light distillate fraction, a second-stage middle distillate fraction, a second-stage heavy distillate fraction, a hydrocracker solvent fraction and a two-stage liquefaction solvent refined coal product;

the improvement comprising:

(1) recycling substantially all of said second stage heavy distillate fraction to said slurry preparation zone and combining said second stage heavy distillate fraction with said solvent in step (a);

(2) combining substantially all of said first-stage middle distillate with said hydrocracker solvent in said hydrocracking zone; and (3) maintaining said distillation zone of step (g) to provide a sufficiently high boiling point of said first-stage solvent fraction to insure that all of said second stage heavy distillate fraction of step (k) is consumed internally within said process via recycle to said coal slurry formed in step (a).

* * * * *